US005147188A

United States Patent [19]

Shaefer

[11] Patent Number: 5,147,188

[45] Date of Patent: Sep. 15, 1992

[54] PRIMING PISTON PUMP PISTON CHECK VALVE

[75] Inventor: Thomas J. Shaefer, Buffalo, Minn.

[73] Assignee: Graco Inc., Minneapolis, Minn.

[21] Appl. No.: 507,629

[22] Filed: Apr. 11, 1990

[51] Int. Cl.[5] ..... F04B 7/02

[52] U.S. Cl. ..... 417/511; 417/513; 417/520

[58] Field of Search ..... 417/510, 511, 512, 513, 417/520

[56] References Cited

U.S. PATENT DOCUMENTS

| | | | |
|---|---|---|---|
| 1,696,007 | 12/1928 | Lewis et al. . | |
| 2,591,969 | 4/1952 | Sawchuk | 103/166.5 |
| 2,655,287 | 10/1953 | Campbell | 222/123 |
| 2,674,956 | 4/1954 | Hilton | 417/513 |
| 2,787,225 | 4/1957 | Rotter | 103/195 |
| 2,804,825 | 9/1957 | Mansfield et al. | 103/41 |
| 3,082,693 | 3/1963 | Budzich | 103/39 |
| 3,312,178 | 4/1967 | Rotter et al. | 103/175 |
| 3,523,745 | 8/1970 | Rich | 417/284 |
| 4,137,017 | 1/1979 | Lonardo | 417/431 |

*Primary Examiner*—Richard A. Bertsch
*Assistant Examiner*—Charles Freay
*Attorney, Agent, or Firm*—Douglas B. Farrow

[57] ABSTRACT

A reciprocating priming piston pump is provided with a piston check valve which provides improved performance by minimizing the pressure drop there through. A dog-bone shaped seat is slideably located inside a piston which in turn slides inside the cylinder of the pump. The piston is restrained at one end by seating upon the valve seat and its outer end by contact with the displacement rod. Rounded surfaces on the valve seat contribute to smooth flow and a slotted guide fingers in the upper end of the piston allow ample flow into the upper chamber from the lower chamber.

5 Claims, 2 Drawing Sheets

PRIMING PISTON PUMP PISTON CHECK VALVE

BACKGROUND OF THE INVENTION

Priming piston reciprocating displacement pumps are well known and have sold for many years by a number of manufacturers such as Graco Inc. (assignee of the instant invention). Such pumps have proven to be less than optimum in the past as restrictions provided by the piston check valve often lead to unbalanced pressures during the up and down strokes of the pump due to the pressure differential which forms across the check valve.

It is therefore an object of this invention to provide a piston check valve which minimizes pressure drop across it and which maximizes flow there through.

It is further an object of this invention to provide a check valve which is easily and inexpensively manufactured.

It is yet a further object of this invention to provide a piston check valve which is high in strength and not subject to fatigue failure.

SUMMARY OF THE INVENTION

A generally dog-bone shaped valve seat is attached (by means of threads or other conventional attachment means) to the end of a double acting pump displacement rod. A first end of the valve seat has a conical seating area which mates with a complementary surface on an annular piston which surrounds the valve seat. The seat has generally smooth and rounded surfaces transitioning between the different areas so as to promote smooth and efficient flow in order to minimize the pressure drop across the check.

The piston is slidably mounted in the annular space formed between the valve seat and the cylinder and has on its external periphery at one end a seal which spaces the remainder of the circumference of the piston inwardly from the bore of the cylinder.

The second end of the piston has a plurality of guide fingers formed therein having slots there between, the slots extending to the second end of the piston. The second end of the piston, that is the end of the guides, is restrained at that end by the end of the displacement rod which is slightly larger in diameter than the inner diameter of the piston.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFFERRED EMBODIMENT

Figure 1:
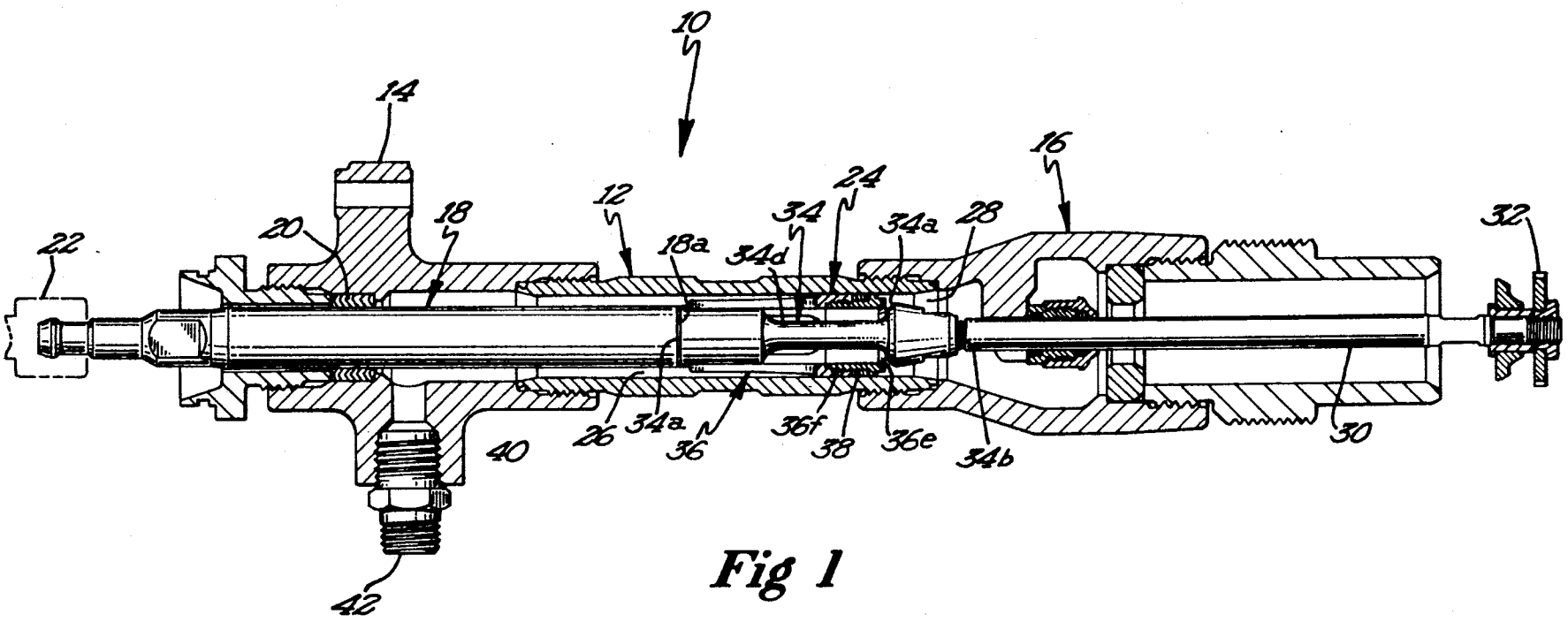
FIG. 1 is a cut-away view taken along the longitudinal axis of the pump of the instant invention.

The pump of the instant invention, generally designated 10, is comprised of a cylinder 12 having upper and lower castings 14 and 16 threadedly attached thereto. A displacement rod 18 is slidingly received within cylinder 12 and is sealed thereto by means of seals 20. Displacement rod 18 is attached at its upper end to motor output shaft 22, which motor may be an air operated reciprocating motor, a reciprocating hydraulic motor or in fact any other means or mode of power.

A piston ckeck assembly, generally designated 24, divides the area contained within cylinder 12 into upper and lower pumping chambers 26 and 28 respectively.

Attached to the lower end of piston check assembly 24 is priming piston rod 30 which has a priming piston 32 attached to the end thereof. The apparatus as described above is considered to be a well known and generic pumping apparatus and what follows constitutes applicant's inventive contribution to the art.

Figure 2:
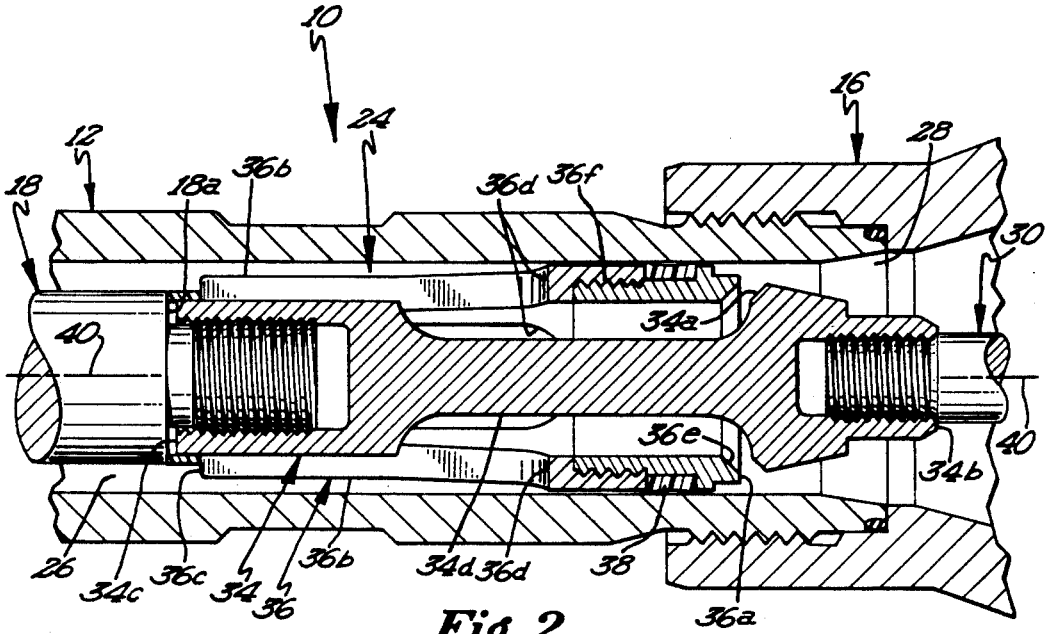
FIG. 2 is an enlarged view of the piston check of the instant invention.

In particular now, referring to FIG. 2, piston check assembly 24 is comprised of a valve seat member 34, a piston 36 and a seal 38 mounted to the outside of piston 36. FIG. 20 shows piston 36 in two positions, piston check assembly 24 being in its open position in the upper half of the figure while being in its closed position in the lower half of the figure, the halves being divided by center line axis 40.

Valve seat member 34 has a conical seating area **34*a* (which may include a carbide insert) along with a tapered first end 34*b*. Second end 34*c* is threadedly attached to the bottom end of displacement rod 18. Valve seat 34 has a reduced diameter center section 34*d* which has smoothly curved transitions into ends 34*b* and 34*c*** so as to allow both efficient fluid flow there through and also to prevent stress risers which would lessen the load carrying capacity of the part.

Figure 3:
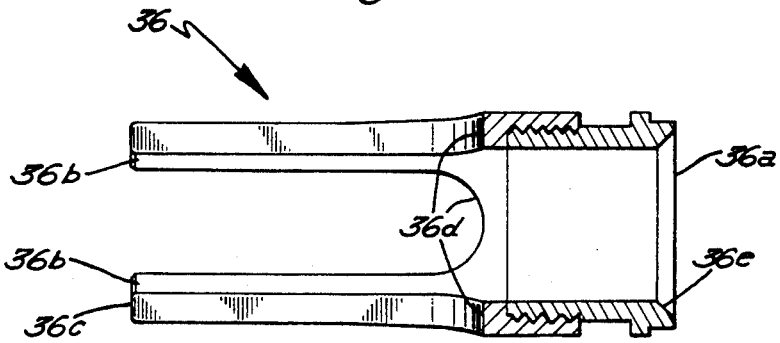
FIG. 3 is a side plan view of the piston of the instant invention.

Piston 36 is shown in FIG. 2 and in more detail in FIG. 3. Piston 36 is provided with a band type packing 38 shown in FIG. 2 which is relatively thin in cross-section thereby allowing a total overall thin profile of piston 36 which in turn allows for larger fluid flow passages and increased fluid flow. If desired, piston 36 may be formed of two parts which screw together at threads **36*f*** to allow assembly of the band packing thereon.

As can be seen in FIG. 2, the outer diameter of piston 36 is less than the inner diameter of cylinder 12 which allows fluid to flow there between. Actually, piston 36 itself does not contact cylinder 12 but rather is contacted strictly by seal 38.

Figure 4:
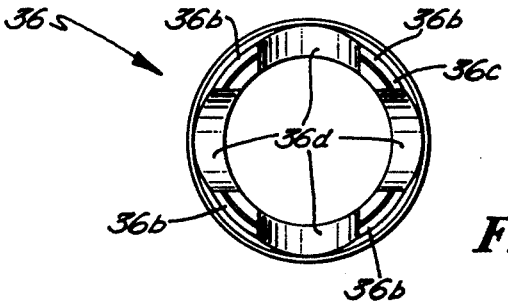
FIG. 4 is an end plan view of the piston of the instant invention.

FIGS. 3 and 4 show the piston in detail and in particular show piston first end **36*a*, piston guides 36*b* which terminate in second end 36*c*. Guides 36*b* are spaced apart by slots 36*d*** through which fluid is allowed to flow.

Decribing operation then of the check valve of the instant invention, when the displacement rod 18 is moving in its downward (or rightward as shown in FIG. 2) stroke, valve seat 34 is positioned relative to piston 36 as shown in the upper half of FIG. 2. That is, fluid is allowed to flow from lower chamber 28 through the annular space between piston 36 and center section **34*d* and thence outwardly through slots 36*d* and piston 36 into upper chamber 26. The motion of piston 36 relative valve seat 34 is caused by the second end 36*c* of piston 36 contacting the edge 18*a* of displacement rod 18**.

When displacement rod 18 reverses for its upward (or leftward) stroke as shown in the bottom half of FIG. 2, conical seating area **34*a* of valve seat contacts the corresponding seating area 36*e* (which may include a carbide insert) of piston 36 thereby sealing under pressure the fluid in upper chamber 26 for pumping it through outlet fitting 42**.

It is contemplated that various changes and modifications may be made to the pump check valve without departing from the spirit and scope of the invention as defined by the following claims.

What is claimed is :

1. In a reciprocating piston displacement pump having a displacment rod in a cylinder having upper and lower chambers and valve means for controlling the flow between said chambers, said valve means comprising:

a valve seat attached to said rod, said valve seat comprising:

seating area first and second ends, each of said valve seat seating area first and second ends having diameters; and a center section having a reduced diameter relative to said valve seat seating area first and second ends, said valve seat center section being smooth and free of grooves;

an annular piston having a circumference and first and second piston ends and being slidably mounted coaxially about said seat, said piston having a conical seating area on said piston first end and a plurality of spaced guides extending toward said piston second end, said piston being slidably located in said cylinder; and seal means mounted between said piston and said cylinder wherein said seat is attached to the lower end of said displacement rod, the length of said piston being less than the distance between said first valve seat seating area and said displacement rod and said seat has a tapered first end and smooth contours over the remainder of said seat to allow fluid to flow from said lower chamber between said seat seating area and said piston seating area when said piston in contacting said displacement rod and thence between the center section of said seat and the interior of said piston first end and thence between said guides into said upper chamber, said seal means extending over only a relatively small fraction of said piston length.

2. The pump of claim 1 wherein said piston is spaced from said cylinder at all times.

3. The pump of claim 1 wherein said valve seat second end has a diameter smaller than that of said displacement rod so as to limit travel of said piston in the direction of said displacement rod.

4. The pump of claim 1 wherein said guides are separated by slots extending axially to second end.

5. The pump of claim 1 wherein said seal is a relatively thin band packing so as to minimize the thickness of said piston and increase the flow area between said piston and said valve seat.

* * * * *

UNITED STATES PATENT AND TRADEMARK OFFICE

CERTIFICATE OF CORRECTION

PATENT NO. : 5,147,188

DATED : September 15, 1992

INVENTOR(S) : Schaefer

It is certified that error appears in the above-identified patent and that said Letters Patent is hereby corrected as shown below:

On the title page, and item (19) inventors should read --

Thomas J. Schaefer --.

Signed and Sealed this

Seventh Day of September, 1993

Bruce Lehman

*Attest:*

BRUCE LEHMAN

*Attesting Officer*

*Commissioner of Patents and Trademarks*